US008408956B1

(12) United States Patent
Vosburgh

(10) Patent No.: US 8,408,956 B1
(45) Date of Patent: Apr. 2, 2013

(54) PAYLOAD DELIVERY UNITS FOR PRESSURE PROTECTING AND DELIVERING A SUBMERGED PAYLOAD AND METHODS FOR USING THE SAME

(75) Inventor: Frederick Vosburgh, Durham, NC (US)

(73) Assignee: iRobot Corporation, Bedford, MA (US)

( * ) Notice: Subject to any disclaimer, the term of this patent is extended or adjusted under 35 U.S.C. 154(b) by 781 days.

(21) Appl. No.: 12/493,933

(22) Filed: Jun. 29, 2009

Related U.S. Application Data

(60) Provisional application No. 61/078,808, filed on Jul. 8, 2008.

(51) Int. Cl.
*B63B 22/16* (2006.01)

(52) U.S. Cl. ..... 441/6; 114/312; 441/28

(58) Field of Classification Search ..... 114/312, 114/321; 367/1, 131, 188; 441/6, 21, 23, 441/28

See application file for complete search history.

(56) References Cited

U.S. PATENT DOCUMENTS

| | | | | |
|---|---|---|---|---|
| 2,737,411 | A | 3/1956 | Potter | |
| 3,626,528 | A * | 12/1971 | Jackson | 441/6 |
| 4,189,786 | A | 2/1980 | Adler | |
| 4,995,842 | A | 2/1991 | Beyer-Olsen | |
| 5,522,337 | A | 6/1996 | Meyers et al. | |
| 6,058,071 | A | 5/2000 | Woodall et al. | |
| 6,254,445 | B1 | 7/2001 | Jones | |
| 6,711,095 | B1 | 3/2004 | Daniels | |
| 6,738,314 | B1 | 5/2004 | Teeter et al. | |
| 6,813,218 | B1 | 11/2004 | Antonelli et al. | |
| 6,899,583 | B2 | 5/2005 | Barden | |
| 6,961,657 | B1 | 11/2005 | Wernli et al. | |
| 7,496,000 | B2 | 2/2009 | Vosburgh et al. | |
| 7,496,002 | B2 | 2/2009 | Vosburgh | |
| 2008/0192576 | A1 | 8/2008 | Vosburgh et al. | |

OTHER PUBLICATIONS

U.S. Appl. No. 12/332,734, filed Dec. 11, 2008, titled "Delivery Systems for Pressure Protecting and Delivering a Submerged Payload and Methods for Using the Same," 38 pages.

* cited by examiner

*Primary Examiner* — Lars A Olson
(74) *Attorney, Agent, or Firm* — Myers Bigel Sibley & Sajovec, PA

(57) ABSTRACT

A payload delivery unit for protecting and delivering a payload submerged in a submersion medium includes an unmanned buoy, a drop weight member, and a retention system. The buoy includes a container. The container includes a pressure-resistant shell defining a sealed containment chamber. The drop weight member is mounted on the shell and has a negative buoyancy with respect to the submersion medium. The retention system is operative to retain the drop weight member on the buoy and selectively release the drop weight member from the buoy.

28 Claims, 10 Drawing Sheets

PAYLOAD DELIVERY UNITS FOR PRESSURE PROTECTING AND DELIVERING A SUBMERGED PAYLOAD AND METHODS FOR USING THE SAME

RELATED APPLICATION(S)

This application claims the benefit of and priority from U.S. Provisional Patent Application Ser. No. 61/078,808, filed Jul. 8, 2008, the disclosure of which is incorporated herein by reference in its entirety.

STATEMENT OF GOVERNMENT SUPPORT

This invention was made with support under Small Business Innovation Research (SBIR) Program No. N00014-07-C-0197 awarded by the United States Navy Office of Naval Research. The Government has certain rights in the invention.

FIELD OF THE INVENTION

The present invention relates to submersible devices and, more particularly, to systems for protecting and delivering submersible payloads.

BACKGROUND OF THE INVENTION

Monitoring littoral seas without being detected can be desirable in times of conflict. In such cases, autonomous submersible monitoring and communications systems can provide much needed intelligence. While such devices can be deployed without detection, communicating the results of monitoring by devices submerged in the sea is problematic. Sonar provides low bandwidth over short ranges and radio communications, at all but the highest powers and lowest data rates, are blocked by salt water. Effective communication requires therefore that an antenna be raised above the sea. A variety of systems have been described for raising an antenna above the sea, but they are either expensive, impractical, or readily detected, making them unsuitable for exporting information without being detected.

SUMMARY OF THE INVENTION

According to embodiments of the present invention, a payload delivery unit for protecting and delivering a payload submerged in a submersion medium includes an unmanned buoy, a drop weight member, and a retention system. The buoy includes a container. The container includes a pressure-resistant shell defining a sealed containment chamber. The drop weight member is mounted on the shell and has a negative buoyancy with respect to the submersion medium. The retention system is operative to retain the drop weight member on the buoy and selectively release the drop weight member from the buoy.

In some embodiments, the drop weight member includes a cap mounted on a portion of and in close proximity to the shell and having a shape generally conformal to an exterior surface of the portion of the shell. The shell may be substantially spherical. In some embodiments, the cap is cup-shaped and is mounted on and surrounds a lower portion of the shell.

According to some embodiments, the retention system includes an electromagnet and a controller operative to control the electromagnet to retain the drop weight member on the buoy and selectively release the drop weight member from the buoy. In some cases, the payload delivery unit includes a permanent magnet on the drop weight member, the drop weight member is secured to the buoy by magnetic attraction between the permanent magnet and the electromagnet, and the retention system is operative to release the drop weight member from the buoy by energizing the electromagnet to at least partly offset the force exerted on the electromagnet by the permanent magnet.

In some embodiments, the retention system includes a mechanical retainer system operative to retain the drop weight member on the buoy and release the drop weight member from the buoy. The mechanical retainer system may include at least one finger on the drop weight member configured to engage and releasably secure the drop weight member to the shell.

In some cases, the drop weight member is fenestrated.

The payload delivery unit may include a pressure generator operable to generate an increase in pressure in the containment chamber to cause the shell to dehisce.

In some embodiments, the shell includes first and second shell members coupled to form the shell and enclose the containment chamber. The drop weight member includes a cap configured and positioned on the shell members to inhibit separation of the shell members from one another when the drop weight member is retained on the buoy by the retention system. The shell members are permitted to separate from one another after the drop weight member is released from the buoy by the retention system.

The retention system may be operative to automatically release the drop weight member from the buoy responsive to a prescribed event and/or environmental condition.

According to some embodiments, the payload delivery unit further includes a deployable drag reducer mounted on the container in a stowed configuration. The drag reducer is retained in the stowed position by the drop weight member. Upon release of the drop weight member from the buoy, the drag reducer is extendable into a deployed configuration wherein the drag reducer extends from the container to streamline the buoy and thereby reduce dynamic fluid drag on the buoy.

According to method embodiments of the present invention, a method for protecting and delivering a payload submerged in a submersion medium, includes providing a payload delivery unit including: an unmanned buoy including a container, the container including a pressure-resistant shell defining a sealed containment chamber; a drop weight member mounted on the shell and having a negative buoyancy with respect to the submersion medium; and a retention system operative to retain the drop weight member on the buoy and to selectively release the drop weight member from the buoy. The method further includes: submerging the buoy, the drop weight member and the retention system in the submersion medium with the drop weight member retained on the buoy by the retention system; and thereafter releasing the drop weight member from the buoy using the retention system.

The method may include automatically releasing the drop weight member from the buoy using the retention system responsive to a prescribed event and/or environmental condition.

In some embodiments, the payload delivery unit further includes a deployable drag reducer mounted on the container in a stowed configuration and retained in the stowed position by the drop weight member, and the method further includes, after releasing the drop weight member from the buoy, extending the drag reducer into a deployed configuration wherein the drag reducer extends from the container to streamline the buoy and thereby reduce dynamic fluid drag on the buoy.

According to embodiments of the present invention, a payload delivery unit for protecting and delivering a payload submerged in a submersion medium includes a container and a deployable drag reducer. The container includes a pressure-resistant container defining a sealed containment chamber. The drag reducer is mounted on the container in a stowed configuration. The drag reducer is extendable into a deployed configuration wherein the drag reducer extends from the container to streamline the buoy and thereby reduce dynamic fluid drag on the buoy.

In some embodiments, the drag reducer includes a flexible, compliant, distensible flow control member. The flow control member may include a polymeric film. In some cases, the payload delivery unit is configured such that the flow control member is distended by a flow of the submersion medium as the buoy buoyantly ascends and/or descends in the submersion medium. The payload delivery unit may include a valve to permit the flow of the submersion medium into the flow control member and to inhibit a flow of the submersion medium out of the flow control member. In some embodiments, the payload delivery unit includes a mounting hoop securing the flow control member to the shell.

The payload delivery unit may include a cap mounted on the container and retaining the drag reducer in the stowed configuration. The cap is releasable from the container to permit the drag reducer to expand into the deployed position.

In some embodiments, the payload delivery system is operative to automatically deploy the drag reducer to the deployed position responsive to a prescribed event and/or environmental condition.

In some cases, the shell is substantially spherical.

According to method embodiments of the present invention, a method for protecting and delivering a payload submerged in a submersion medium includes providing a payload delivery unit comprising an unmanned buoy including: a container including a pressure-resistant shell defining a sealed containment chamber; and a deployable drag reducer mounted on the container in a stowed configuration. The method further includes: submerging the container and the drag reducer in the submersion medium with the drag reducer in the stowed configuration; and thereafter extending the drag reducer into a deployed configuration wherein the drag reducer extends from the container to streamline the buoy and thereby reduce dynamic fluid drag on the buoy.

In some embodiments, the method includes automatically extending the drag reducer into a deployed configuration responsive to a prescribed event and/or environmental condition.

According to embodiments of the present invention, a payload delivery unit for protecting and delivering a payload submerged in a submersion medium includes an unmanned buoy, a cap, and a retention system. The buoy includes a container. The container includes a pressure-resistant shell defining a sealed containment chamber. The shell includes first and second shell members coupled to form the shell and enclose the containment chamber. The cap is mounted on the shell. The retention system is operative to retain the cap on the buoy and selectively release the cap from the buoy. The cap is configured and positioned on the shell members to inhibit separation of the shell members from one another when the cap is retained on the buoy by the retention system. The shell members are permitted to separate from one another after the cap is released from the buoy by the retention system.

Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

FIGS. 6A-8 are schematic views illustrating methods of deploying and operating the payload delivery unit of FIG. 1.

DETAILED DESCRIPTION OF EMBODIMENTS OF THE INVENTION

Figure 1:
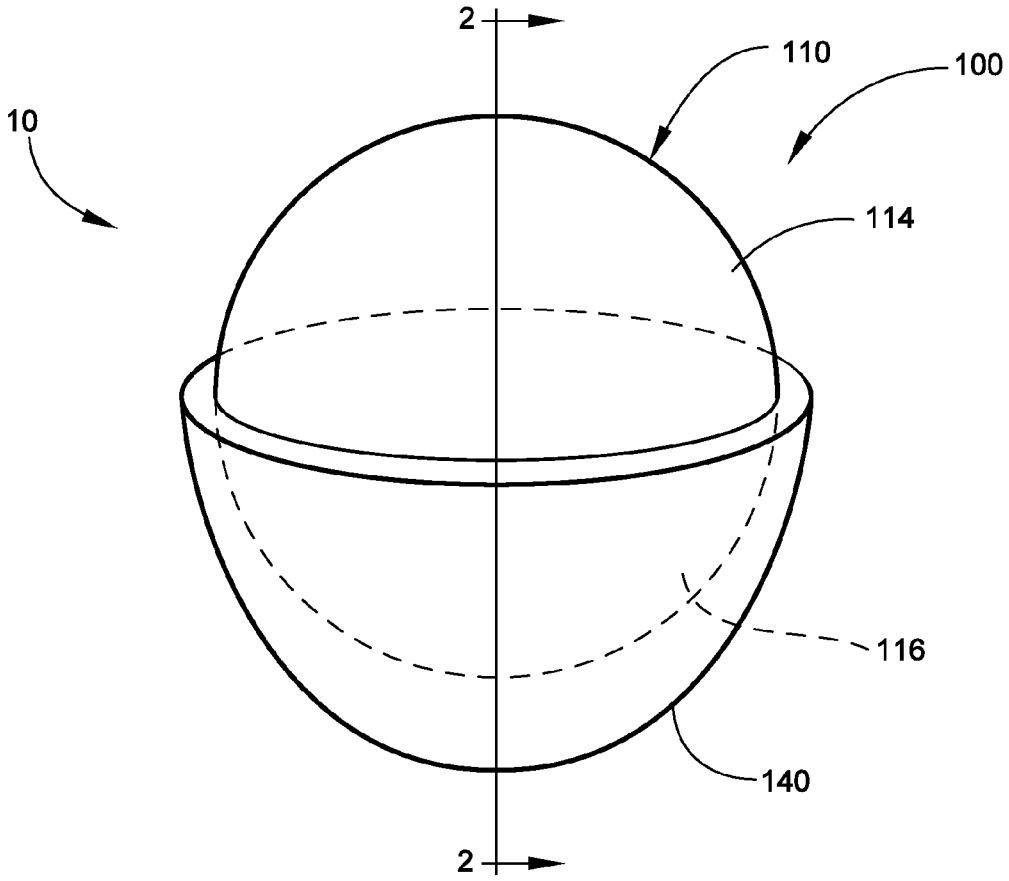
FIG. 1 is a perspective view of a payload delivery unit according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

With reference to FIGS. 1-8, a payload delivery unit 10 according to embodiments of the present invention is shown therein. The payload delivery unit 10 includes a pressure protective container system 100 and a payload or contents 150 (FIG. 2), such as operational contents. The container system 100 includes a container assembly or container 110 within which the payload 150 is housed, a buoyancy control system 130, and a drag reducer system 160. The payload delivery unit 10 may be used in conjunction with a secondary object 7 such as a vehicle or platform from which the payload delivery unit can be dispensed or deployed. The payload 150 may itself comprise a self-contained subunit that can be released from the container 110.

Figure 2:
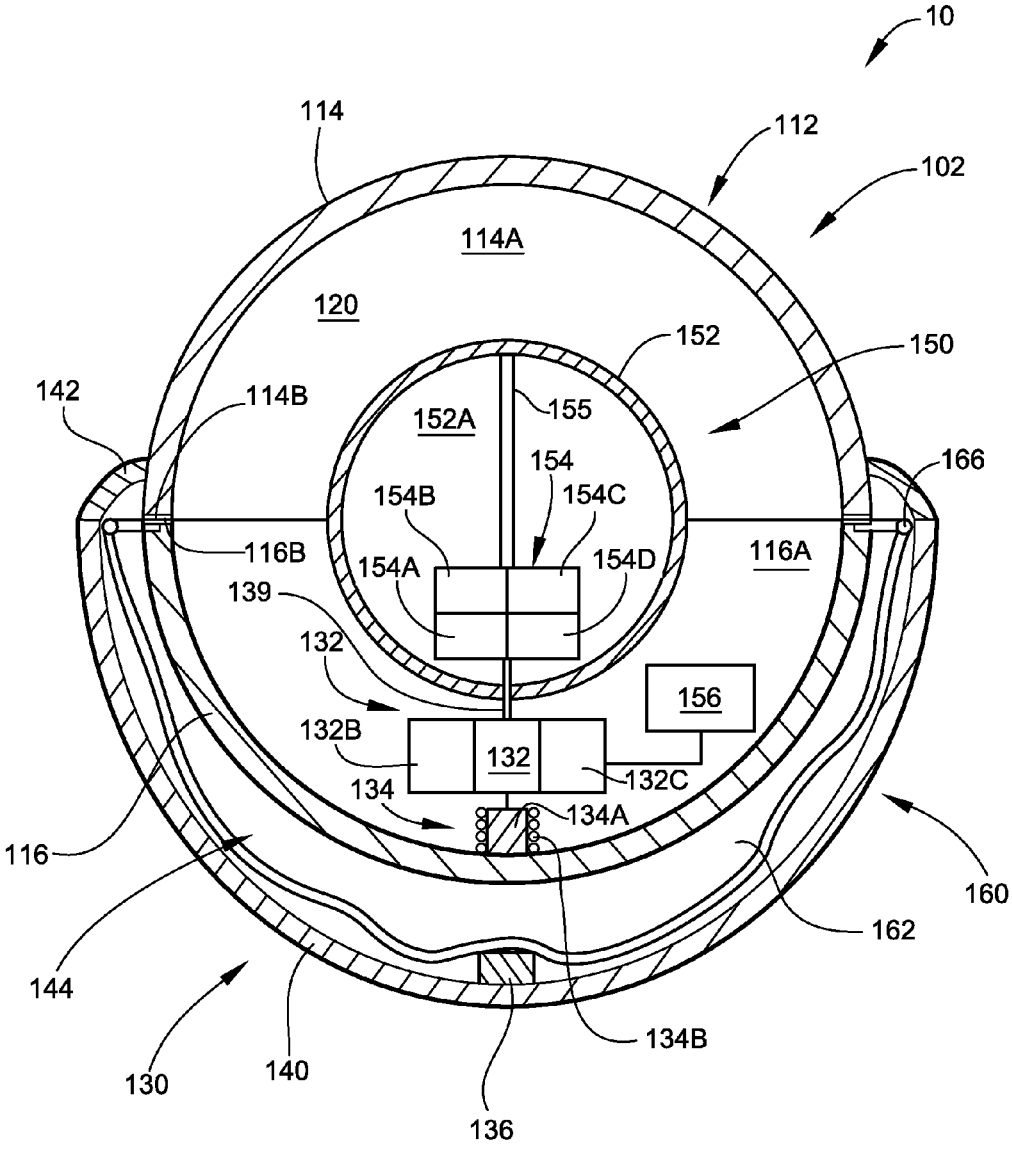
FIG. 2 is schematic, cross-sectional view of the payload delivery system of FIG. 1 taken along the line 2-2 of FIG. 1.
Figure 4:
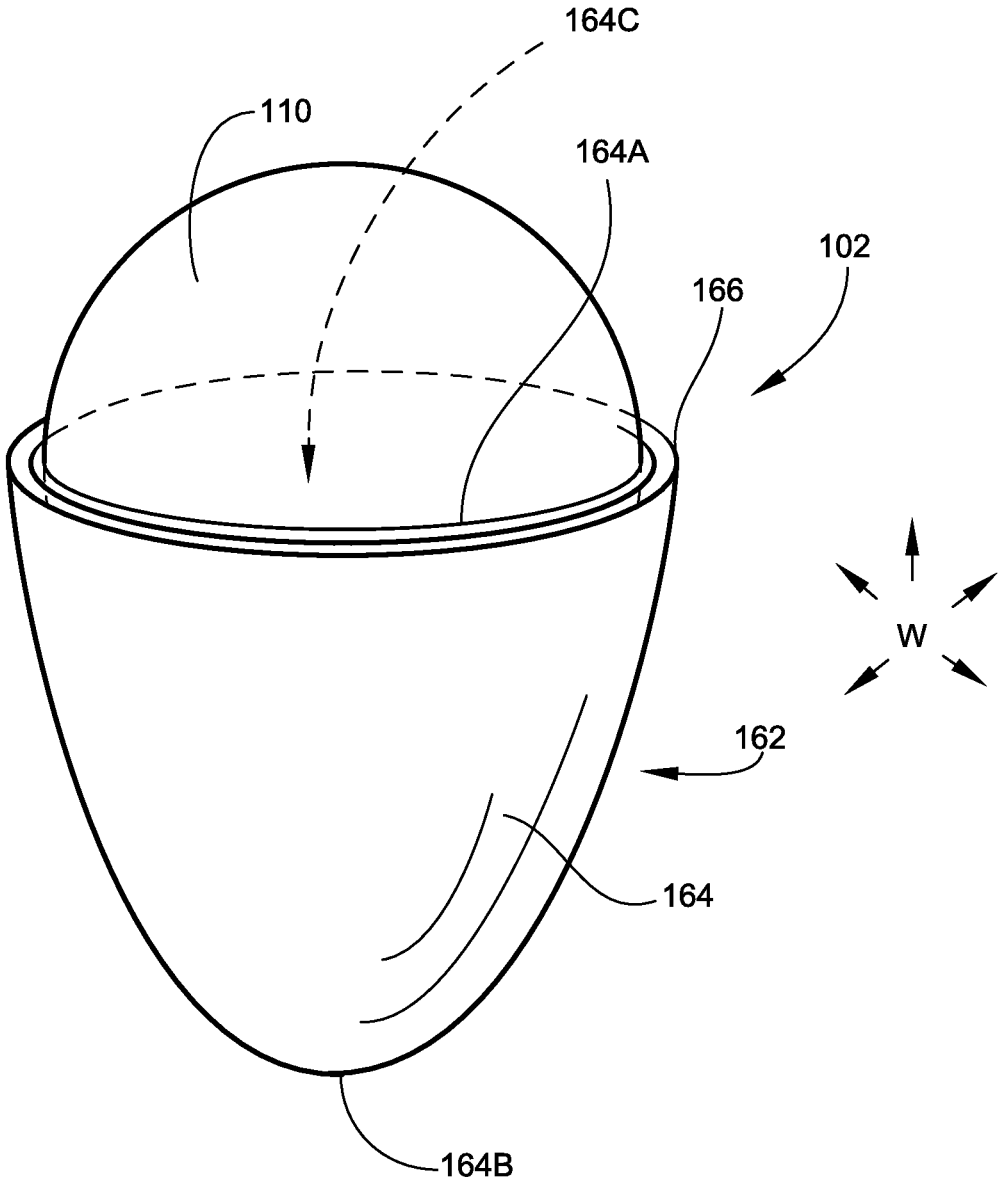
FIG. 4 is a perspective view of the payload delivery unit of FIG. 1 wherein the drag reducer is fully deployed.

With reference to FIG. 2, the buoyancy control system 130 includes a buoyancy control module 132, an electromagnet 134, a drop weight member or ballast weight (hereinafter referred to as a cap) 140 mounted on the container 110, and a cap magnet 136 mounted on the cap 140. As discussed in more detail below, the buoyancy control system 130 is operable to selectively release the cap 140 from the container 110 to reduce the buoyancy of the payload delivery unit 10 (which, less the weight member 140, is referred to herein as a buoy 102; FIG. 4).

The drag reducer system 160 includes an expandable fairing or drag reducer 162 mounted on the container 110. As discussed in more detail below, the drag reducer 162 is selectively expandable, distendable or extendable from a relatively compact stowed configuration (as shown in FIGS. 1 and 2 to a relatively expanded deployed configuration (as shown in FIG. 4) in order to fluid dynamically streamline the buoy 102. According to some embodiments, the drag reducer 162 is maintained in its stowed configuration when the cap 140 is mounted on the container 110, and is expanded into its deployed configuration upon release and separation of the cap 140 from the container 110.

In general, the payload delivery unit 10 can be deployed in a body of water W (FIGS. 6A-8) such that the container 110 (and the payload 150 therein) is submerged at a depth. The container 110 protects the payload 150 from water pressure at the depth and may thereby protect the payload 150 from damage that may otherwise occur to the payload 150 due to such water pressure. The container 110 may also protect the payload 150 from exposure to the water W at other than a desirable time or depth.

When it is desired for the container 110 to ascend and/or for the container 110 to ascend at a higher or maximized rate, the buoyancy control system 130 releases or repels the cap 140 from the container 110, thereby increasing the net buoyancy of the remainder of the payload delivery unit 10 (i.e., the buoy 102).

The release of the cap 140 also permits the drag reducer 162 to expand into its deployed configuration to fluid dynamically streamline the buoy 102. According to some embodiments, the buoyancy control system 130 automatically releases the cap 140 responsive to a prescribed event (e.g., elapse of a period of time) and/or a prescribed environmental condition.

According to some embodiments, the cap 140 is released responsive to a prescribed event including at least one of elapse of a prescribed period of time, achievement or attainment of a prescribed depth, detection of a prescribed signal, receipt of a command, attainment of a prescribed location, and occurrence of a prescribed operational condition. These and further aspects of the system 10 and the payload delivery unit 10 and systems and methods employing the same will now be described in further detail.

Figures 6A, 6B, 6C:
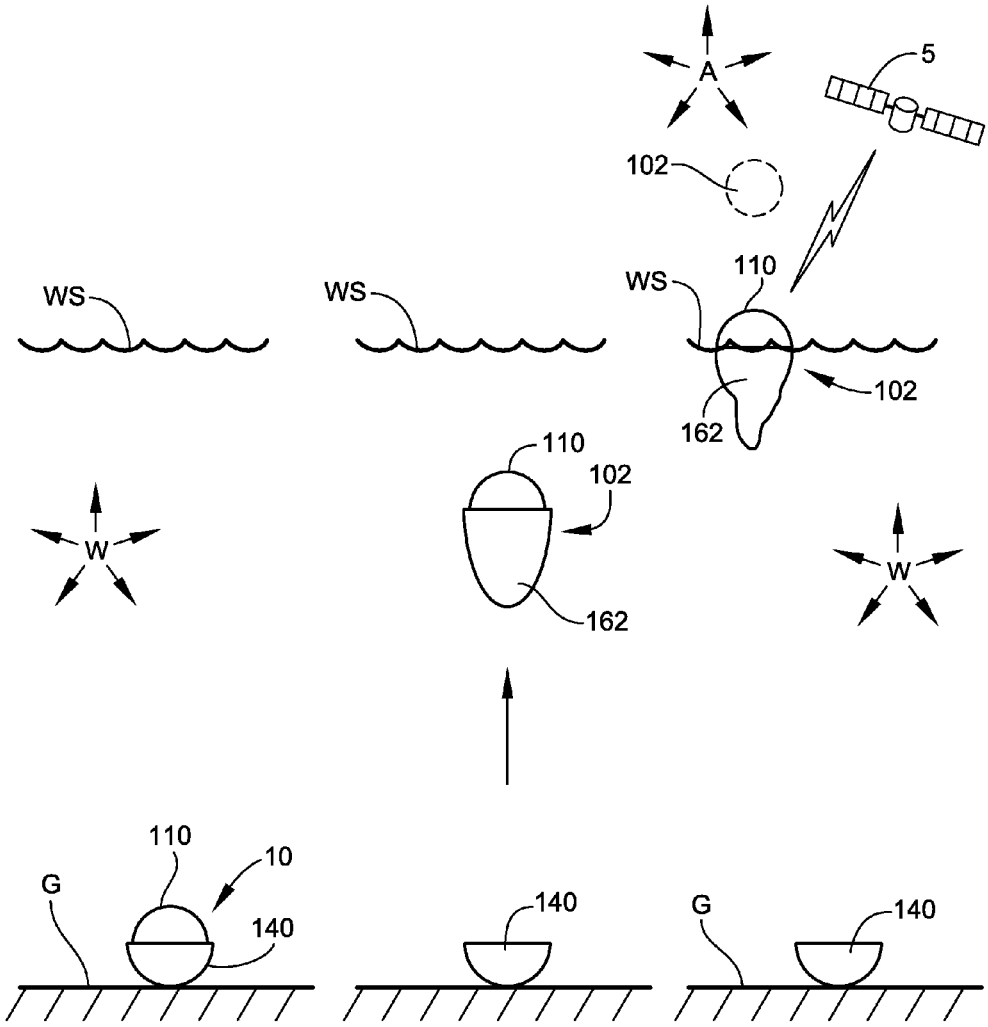

In some embodiments, the payload 150 is a communications device adapted or configured to communicate by sending signals to and/or by receiving signals from a remote device 5 (e.g., a satellite or air vehicle; FIG. 6C) from a location proximate or on the surface WS of the water W (as shown in FIG. 6C) or from a location in the air A above the surface of the water (as shown in dashed lines in FIG. 6C). Systems and methods of the present invention may be used for communications between a submerged object or location and a remote user. In some cases, the payload 150 is also configured as a sensing device for environmental, oceanographic, intelligence, surveillance, or reconnaissance uses, which sensing is conducted in air A or water W. In some embodiments, the payload 150 includes a communications device as disclosed in U.S. patent application Ser. No. 11/494,941 (published as U.S. Published Application No. 2008/0192576 A1), the disclosure of which is incorporated herein by reference.

With reference to FIGS. 1 and 2, the container 110 includes a shell 112. The shell 112 includes two or more substantially rigid shell members 114, 116. The shell members 114, 116 each have a respective perimeter face 114B, 116B (FIG. 2) defining an opening communicating with a respective cavity 114A, 116A (FIG. 2). Perimeter grooves may be located in the faces 114B and 116B to serve as alignment features. The shell members 114, 116 are mated such that their perimeter faces 114B and 116B juxtapose or overlap (and may seat in the corresponding grooves to form a face or a lap joint). A seal member such as an adhesive or compliant member (e.g., an elastomeric O-ring) may be interposed between the mating portions of the shell members 114, 116 to effect an improved water-resistant seal.

The shell members 114, 116 together define an interior containment chamber 120 of the shell 112. According to some embodiments, the payload 150 is substantially fully contained in the chamber 120. According to some embodiments, the shell 112 is water submersible so that water is prevented from contacting the payload 150 (or water-sensitive components thereof).

The shell 112 may be of any suitable size and shape. In some embodiments, the shell 112 is substantially spherical as shown and the shell members 114, 116 are hemispherical. According to some embodiments, the chamber 120 has a size in the range of from about 4 to 50 centimeters in diameter, which for a spherical shape corresponds to a volume in the range of from about 0.03 to 6.5 liters. According to some embodiments, the chamber 120 has a volume in the range of from about 0.1 to 1.0 liters.

The shell 112 may be formed of any suitable material. According to some embodiments, the shell 112 is formed of a material such as Plexiglass, polycarbonate, glass or glass-filled or fiber-filled polymer.

The shell 112 may have any suitable size and volume. In some embodiments, the volume of the shell 112 and the volume of the chamber 120 are selected to provide a desired buoyancy to thereby provide a desired rate of change in depth when permitted to float freely (with and/or without the cap 140). The shell 112 may be sized so that it can rise buoyantly at a desirable rate from a deployment depth to a desirable release depth, such as one at which the payload is not damaged by water pressure and can be released.

The buoyancy control system 130 can operate using any suitable principle or mechanism secure the cap 140 to the shell 112 and/or release the cap 140 from the shell 112 using, for example, a magnetic attraction between the cap 140 or a component thereon and the container 110 or a component thereon. According to some embodiments and as illustrated, the buoyancy control system 130 holds the cap 140 on and releases the cap 140 from the shell 112 and the buoy 102 using an electromagnet.

An exemplary buoyancy control system 130 as illustrated in FIG. 2 includes a buoyancy control module 132, an electromagnet 134 mounted on the shell 112 (e.g., in the chamber 120), and a magnetically attractable portion or member 136 mounted on the cap 140. According to some embodiments, the magnetically attractable portion 136 is a permanent magnet. The buoyancy control module 132 includes a controller 132A, a transducer 132B, a battery 132C, and a link 139 to the payload 150. The buoyancy control module 132, the electromagnet 134, and the member 136 may form, at least in part, a retention system or mechanism operative to retain and selectively release the cap 140 with respect to the container 110.

The cap 140 may have any suitable shape and composition. In some embodiments, the cap 140 is a cup or cup-shaped. According to some embodiments and as shown, the cap 140 has a shape of a truncated sphere or ellipsoid, defines an interior cavity 141 (FIG. 3) and is generally conformed to the shell 112. In some embodiments, the cap 140 includes a compliant lip 142 (FIG. 2) that adjoins or engages the shell 112 to provide a smooth transition or profile between the cap 140 and the shell 112. In the drawings, the width of the lip 142 is exaggerated for the purpose of explanation. The cap 140 may overlap one or both of the shell members 114, 116.

According to some embodiments, the cap 140 sinks in the submersion medium (e.g., water). In some cases, the cap 140 is formed of a material having a specific gravity greater than the submersion liquid W. In some cases, the cap material specific gravity is in the range of from 1 to 10 times that of the submersion liquid. Suitable materials for the cap 140 may include metal, plastic, ionic solid, composite, stone or ceramic.

When mounted on the shell 112, the shell 112 and the cap 140 define a stowing chamber 144 therebetween. As discussed herein, the drag reducer 162 can be contained in the stowing chamber 144 pending deployment of the drag reducer 162.

The controller 132A may be any suitable device or devices configured to enable the methods discussed herein. The controller 132A can be configured to provide operational control, to store signals, and/or to provide signals. The controller 132A may include a microprocessor. The controller 132A may execute, initiate and/or coordinate actuation and/or deactuation of the electromagnet 134, sensing of an event or parameter (e.g., an environmental condition), processing of sensed or received data, and/or communication with an external device. In some embodiments, the controller 132A is responsive to a processing result and/or a state of the shell 112 to initiate release the cap 140 from the buoy 102.

The transducer 132B may include any suitable device or devices to support desired operations of the payload 150. According to some embodiments, the transducer 132B includes a radio or other wireless communication device that can send and/or receive a signal. The received and/or transmitted signals may include data such as a command, program, or update. In some embodiments, the transducer 132B employs a physical connection in place of or additional to a wireless connection.

The transducer 132B may include a transmitter. Examples of suitable transmitters include a radio antenna circuit, an optical source, or a sonar transponder. The transmitter may include an acoustic detector, an acoustic emitter, an optical sensor, an optical emitter, an electromagnetic wave sensor, and/or an electromagnetic wave emitter.

In some cases, the transducer 132B includes a sensor. According to some embodiments, the sensor is adapted to sense a parameter of the container system 100 itself, a parameter external to the container system 100, or an exogenous signal. According to some embodiments, the sensor is adapted to sense a parameter of the water W. According to some embodiments, the sensor includes an acoustic detector, an RF detector, a hydrophone, an optical detector, a camera, and/or an environmental sensor. Detected or transmitted signals may include, for example, radio, magnetic, electric, electromagnetic, mechanical, chemical, optical, and/or environmental signals.

The drag reducer system 160 includes the drag reducer 162, a mounting hoop 166 and/or one or more hangers 168. With reference to FIG. 4, the drag reducer 162 includes a body 164 having a leading end 164A coupled to the shell 112 by the mounting hoop 164 and/or the hangers 168. The body 164 has a free, trailing end 164B opposite the leading end 164A. According to some embodiments, the trailing end 164B of the drag reducer 162 is closed.

The drag reducer 162 may be formed of any suitable material. According to some embodiments, the drag reducer 162 is formed of a flexible, pliable, compliant material configured as a flow control skin or tail. In some embodiments, the pliable flow control member takes the form of a closed ended pouch or bag as shown; however, other configurations may be employed. According to some embodiments, the drag reducer 162 is formed of a polymeric film.

Figure 3:
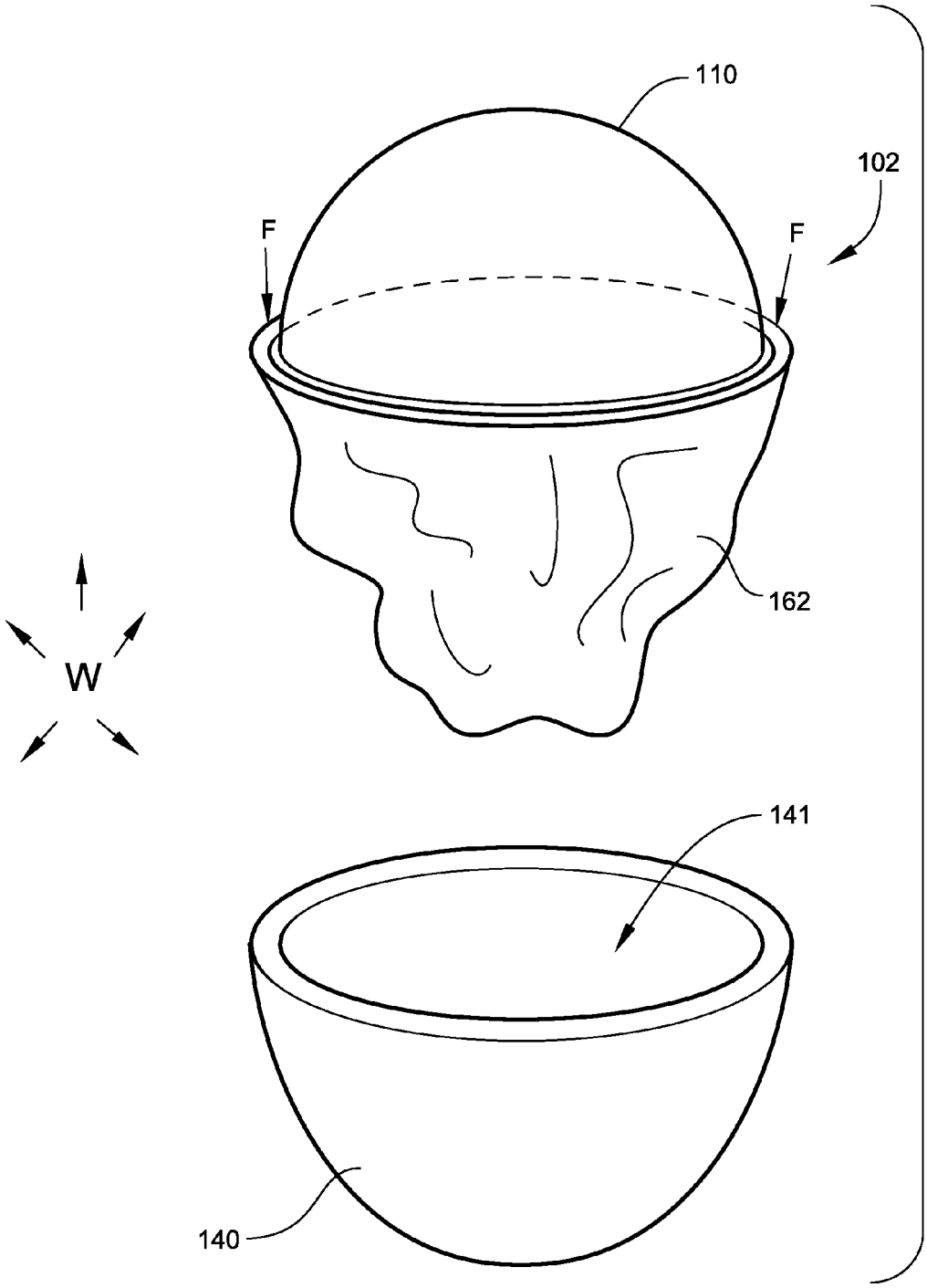
FIG. 3 is a perspective view of the payload delivery unit of FIG. 1 wherein a cap thereof has been released and a drag reducer is partially deployed.
Figure 5:
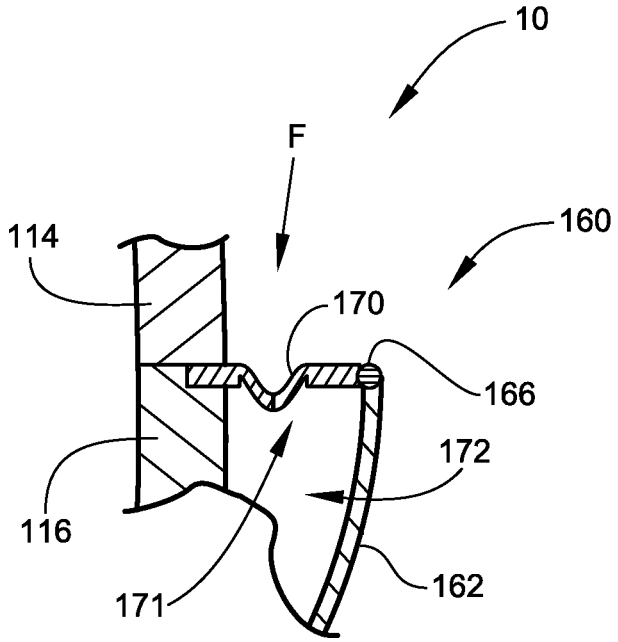
FIG. 5 is a fragmentary, enlarged, cross-sectional view of the payload delivery unit of FIG. 1 illustrating a coupling between the drag reducer and a shell of the payload delivery unit.

The hangers 168 extend radially inwardly from the hoop 164 to lay proximate the shell member face to couple the hoop 166 and the drag reducer 162 to the shell 112. In some embodiments and as shown in FIG. 5, the leading end 164A of the drag reducer 162 defines an opening 164C (FIG. 4) that is held open or spaced apart from the shell 112 by the hoop 166. In the drawings, the spacing between the hoop 164 and the shell 112 is exaggerated for the purpose of explanation. When expanded, the drag reducer 162 defines a cavity 172 (FIG. 4). The gap(s) 171 provided between the drag reducer 162 and the shell 112 provide an inlet for the water W to flow into the cavity 172 (i.e., in an inflow direction F; FIGS. 3 and 5) to inflate or pressurize the interior of the drag reducer 162 when the buoy 102 is rising. In some embodiments, a valve or valves 170 (FIG. 5) are provided to permit the water to enter the cavity 172 while retarding, inhibiting or preventing the water from escaping the cavity 172 through said gaps 171. In this way, the water may be forced into and retained in the cavity 172 to maintain the desired drag reducer exterior profile. Outpockets or other elements may be provided to direct water into the space between the shell 112 and the drag reducer 162. Other mechanisms may be used to secure the drag reducer 162 to the shell 112 such as gluing, bonding, fastening, fusing, adhering, overlapping, enveloping, hooking, snap-fitting or hanging. According to some embodiments and as illustrated, the exterior profile of the drag reducer 162 is substantially conical in shape.

According to some embodiments, the drag reducer cavity 172 has a volume in the range of from about 10 to 500% of the volume of the shell 112. According to some embodiments, the distended drag reducer 162 has a length from the leading end 164A to the trailing end 164B in the range of from about 0.1 to 10 times the diameter of the shell 112.

The drag reducer 162 is initially disposed or contained in the stowing chamber 144 in a compressed or compacted stowed configuration as shown in FIG. 2. In the stowed configuration, the drag reducer 162 may be wadded, folded and/or rolled into a relatively small volume. Upon deployment, the drag reducer 162 unravels, unfolds, unrolls, and/or inflates into a relatively larger volume as shown in FIG. 4.

The payload 150 (FIG. 2) may be of any suitable type and configuration that is desirably stowed, conveyed or deployed with respect to a submerged location or desirable deployment depth. As discussed above, the payload 150 may in some embodiments include a self-contained unit and, more particularly, may include a self-contained communications device. In some embodiments and as shown in FIG. 2, the payload 150 includes a skin or housing 152 defining an interior chamber 152A and an operational module 154 contained in the chamber 152A. The operational module 154 can include a controller 154A, a transducer 154B, a destructor 154C and a battery 154D.

The payload housing 152 may be of any suitable type capable of providing protection for the contents of the chamber 152A from exposure to water and/or water pressure. According to some embodiments, the housing 152 is a flexible skin formed from a plastic or elastic material or film.

The payload controller 154A may be any suitable device or devices configured to enable the methods discussed herein. The controller 154A may be configured to control, activate, energize, modify or destruct the shell 112, the buoyancy control system 130, the link 139, the housing 152, the transducer 154B, the destructor 154C and/or the battery 154D The controller 154A may include a processor configured to accept and process a signal such as a command, communication, trigger, alarm, activation or initiation. According to some embodiments, the controller 154A is operatively connected to the buoyancy control module 132 by the link 139 to transmit signals therebetween.

The transducer 154B may be connected to the controller 154A and can be configured to send and/or receive a signal. The transducer 154B may include a radio and an associated antenna 155. The transducer 154B may be configured to modify a signal and may include a conditioner, converter and/or processor for this purpose. The transducer 154B may be capable of sending and/or receiving at least one of an electrical, optical, magnetic, inductive, radio frequency, thermal and mechanical signal.

The destructor 154C is configured to, when activated, render at least a portion of the payload 150 inoperable. In some embodiments, the destructor 154C can be activated to rend or breach the housing 152. In some embodiments, the destructor 154C can be activated to overload the circuits of or destroy the controller 154A and/or the transducer 154B.

The battery 154D may be connected to provide power to one or more of the buoyancy control module 132, the link 139, the payload housing 152, the controller 154A, the transducer 154B, and the destructor 154C.

The container system 100 may also include a dehiscing system 156 (FIG. 2) operable to selectively exert a force or pressure on the shell 112 tending to open the shell 112 and expose the payload 150. According to some embodiments, the container system 100 includes a dehiscing system as disclosed in U.S. patent application Ser. No. 12/408,177, filed Mar. 20, 2009, the disclosure of which is incorporated herein by reference. The dehiscing system 156 may include a pressure generator.

The pressure generator may be any suitable device capable of providing an increase in the internal pressure in the chamber 120 sufficient to dehisce the container 110. According to some embodiments, the pressure generator generates additional internal pressure in the chamber 120 by heating the volume of gas therein. According to some embodiments, the heated gas in the chamber is a fixed amount of gas. According to some embodiments, the pressure generator is a gas provider that can provide additional gas to the chamber 120 to increase the pressure in the chamber 120. The gas provider may provide additional gas by releasing a gas (e.g., compressed gas from a container), oxidizing a material (e.g., by igniting), volatilizing to cause release of a volatile gas (e.g., by heating a petrochemical or a carbonate material), and/or generating a gas by chemical reaction.

In some embodiments, the pressure generator is a gas generator including a heating element coated with or placed proximate a gas providing material such as potassium permanganate powder. Potassium permanganate is known to react chemically in the presence of heat to release oxygen gas. In some cases, the heating element is disposed in a housing that separates the heating element from portions of the shell 112 and/or the payload 150 that might otherwise be adversely affected by heat. The housing permits the flow of gas through the housing. Other suitable gas generators for the pressure generator include a gas generator that contains a chemically reactive substance (e.g., an acid, base, salt or water) with a reactive metal, salt, mixture, composition or solution. For example, gas may be provided by mixing a metal such as lithium or a salt such as lithium hydride with water to generate a gas (e.g., hydrogen).

The payload delivery unit 10 may be constructed by any suitable technique. The payload 150 and the buoyancy control module 132 are positioned in the shell members 114, 116 and a suitable seal is effected between the shell members 114, 116.

In some cases, the payload 150 is sealed in the shell 112 with excess or injected gas, for example at the time of final assembly, to provide an internal pressure greater than zero atmospheres (gauge). In some cases, the shell 112 is assembled at a reduced environmental temperature to produce elevated internal pressure in use. Alternatively, the shell 112 can be assembled and sealed while inside an assembly apparatus operated at between 0 and 20 atmospheres (gauge) to produce a dehiscing pressure at a desirable dehiscing depth. In use, the increased internal pressure can cause or assist in separation of the shell members 114, 116 to dehisce the container 110. In some embodiments, the dehiscing system 156 can be omitted or remain unactivated, and the container 110 is dehisced by the elevated positive pressure in the chamber 120 when said chamber pressure exceeds the external pressure imposed by the water W and the resistance to dehiscing presented by the seal.

In some cases, the payload 150 is sealed in the shell 112 at a reduced atmospheric pressure or an elevated environmental temperature to produce reduced or sub-atmospheric internal pressure in use. In use, the reduced internal pressure can prevent or inhibit separation of the shell members 114, 116 until actuation of the dehiscing system 156 to dehisce the container 110.

The payload delivery unit 10 can be used to contain and protect the payload 150 in the chamber 120 until a desired or prescribed event or condition occurs, whereupon the buoyancy control system 130 will cause the cap 140 to separate from the container 110. In this manner, the buoyancy of the payload delivery unit 10 can be reduced at a desired time or under prescribed circumstances. The buoyancy control system 130 may cause the cap 140 to be released or ejected from the container 110 using a suitable actuator automatically in response to the desired or prescribed event or condition.

According to some embodiments, in water W the cap 140 has a negative buoyancy and the buoy 102 has a positive buoyancy. According to some embodiments, the payload delivery unit 10 (with the cap 140 mounted on the buoy 102) has a negative buoyancy in the water W.

The prescribed event or condition that triggers the buoyancy control system 130 to drop the cap 140 from the container 110 may depend on the nature of the deployment, the nature and characteristics of the payload 150, the intended operations, and other structural and operational factors and attributes. According to some embodiments, the cap 140 is dropped responsive to a prescribed event including at least one of elapse of a prescribed period of time, achievement or attainment of a prescribed depth, detection of a prescribed signal, receipt of a command, attainment of a prescribed location, and occurrence of a prescribed operational condition.

In use, the payload delivery unit 10 is suitably deployed in the water W. For example, as described hereinbelow, the payload delivery unit 10 may be deposited on the substratum G or may float, be carried or hover at an intermediate depth in the water W between the substratum G and the surface WS of the water. The payload delivery unit 10 may remain at or near the deposited depth for some period of time. In some cases, the system can comprise a plurality of separately releasable payload delivery units 10.

Thereafter, the buoyancy control system 130 releases from the cap 140 from the container 110, thereby providing the buoy 102 having a greater net buoyancy than the payload delivery unit 10. The cap 140 separates from the buoy 102 and descends through the water W as shown in FIG. 3. The buoy 102 will then ascend through the water W. In some embodiments, the payload delivery unit 10 is itself lighter than the water W and ascending prior to release of the cap 140, in which case the release of the cap 140 enables the buoy 102 to ascend more quickly than when attached to the cap 140.

Release of the cap 140 from the container 110 also displaces the cap 140 from the shell 112 to open the stowing chamber 144, thereby freeing the drag reducer 162 to extend and expand from the stowed configuration (FIGS. 1 and 2) to the deployed configuration (FIG. 4). More particularly, as the buoy 102 rises, the flow of the water W relative to the shell 112 and the drag reducer 162 causes the water to flow into the cavity 172 through the valve 170 as indicated by the arrow F in FIGS. 3 and 5. The cavity 172 is thereby filled and/or pressurized by water W to expand and substantially maintain the distended configuration of the drag reducer 162. FIG. 3 shows the drag reducer 162 in an intermediate, partially filled condition.

The distended drag reducer 162 can act as a weathervane (with the end 164B (FIG. 4) pointed down) to orient the rising buoy 102. In some embodiments, the contents of the shell 112 are located and secured in the shell 112 so that the buoy 102 has a center of mass or weight beneath the center of buoyancy of the shell 112 to create a passive righting moment on the buoy 102.

In the deployed configuration, the drag reducer 162 provides the buoy 102 with a more streamlined profile (i.e., a lower drag coefficient) with respect to the water W than that of the shell 112 without the deployed drag reducer 162 as the buoy 102 ascends in the water W toward the water surface WS. By contrast, spherically-shaped containers tend to suffer high drag when ascending through water. According to some embodiments, the deployed drag reducer 162 promotes laminar flow about the buoy 102 and reduces eddies. According to some embodiments, the drag coefficient of the buoy 102 is reduced by at least 5% by the deployed drag reducer 162.

The buoyancy control system 130 may induce release of the cap 140 from the container 110 by any suitable technique or mechanism. In some embodiments, the electromagnet 134 includes a metal (e.g., iron) core 134A surrounded by an electrically conductive coil 134B and the magnet 136 on the cap 140 is a permanent magnet. Prior to release of the cap 140, the electromagnet 134 is non-energized and the cap 140 is held to the shell 112 by the magnetic attraction between the magnet 136 and the core 134A. In order to release the cap 140, the controller 132 energizes the coil 134B to generate a magnetic repulsion force that opposes and exceeds the attractive force between the magnet 136 and the core 134A, thereby pushing the cap 140 off of the container 110. In other embodiments, the electromagnet 134 is configured to attract the component 136 and the cap 140 is released by deactivating the electromagnet 134. In some embodiments, the coil 134B is coated with a material that releases a pressurizing gas in response to heating of the coil 134B (from being energized) to assist in opening or dehiscing the shell 112.

According to some embodiments, the core 134A is centered with respect to the bottom shell member 116. In other embodiments, the core 134A may be mounted off-center on the bottom shell member 116 to provide a tipping moment that after shell opening causes the bottom shell member 116 to fill with water to assist in scuttling. Off-center mounting can be used to orient the shell 112 with respect to the vertical, for example to orient the shell faces 114B, 116B more or less vertically prior to opening to orient with respect to the cap 140. The cap 140 can hold the shell members 112, 114 together to prevent leaking such as when the payload delivery unit 10 is first dropped in water from a ship.

According to some embodiments, the cap 140 is automatically released from the buoy 102 responsive to the triggering event or condition. According to some embodiments, the cap 140 is released responsive to a prescribed event including at least one of elapse of a prescribed period of time, achievement or attainment of a prescribed depth, detection of a prescribed signal, receipt of a command, attainment of a prescribed location, and occurrence of a prescribed operational condition.

Figure 8:
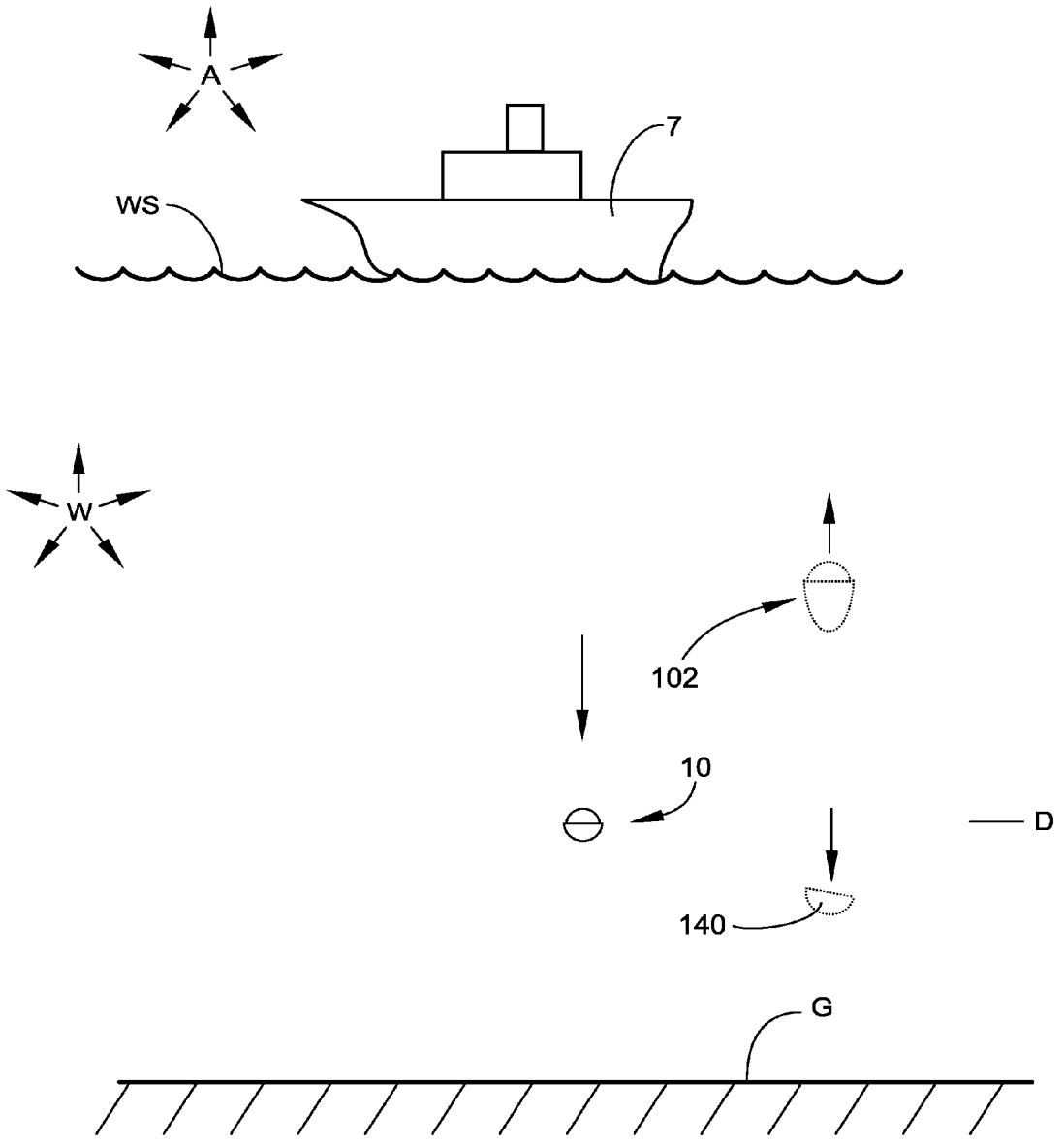

By way of further example, the buoyancy control module 132 may cause cap 140 to drop from the container 110 only when the payload delivery unit 10 receives a command, such as by a mechanism or method other than wire or tether from a remote device (e.g., the vehicle 7 of FIG. 8).

More particular methods of use of the payload delivery system 10 will now be described with reference to FIGS. 6A-8. However, it will be appreciated that these methods are not exhaustive of methods of the present invention.

With reference to FIG. 6A, the payload delivery unit 10 may be placed on the substratum G. While in this position, the payload 140 may monitor signals or environmental parameters as discussed herein. When triggered by an event or condition as discussed above, the controller 132A releases the cap 140 from the buoy 102. The buoy 102 ascends and the drag reducer 162 deploys as discussed above and as shown in FIG. 6B until the buoy 102 reaches the water surface WS (FIG. 6C), for example.

Figures 7A, 7B:
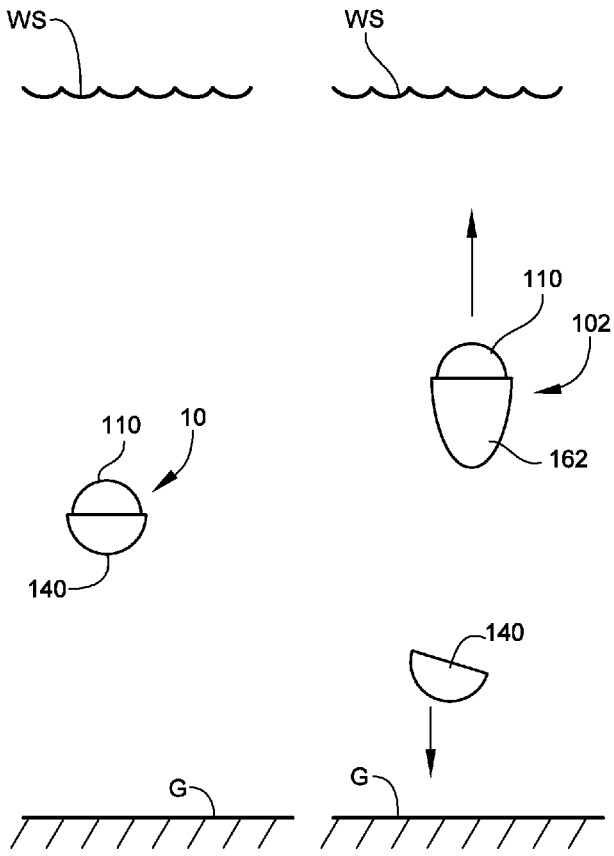

With reference to FIGS. 7A and 7B, the payload delivery unit 10 may have a buoyancy that enables the payload delivery unit 10 to float neutrally buoyantly between the substratum G and the water surface WS when deployed, as shown in FIG. 7A. While in this position, the device 10 (e.g., using the payload 140) can monitor signals or environmental parameters as discussed herein. When triggered by an event or condition as discussed above, the controller 132A releases the cap 140 from the buoy 102. The buoy 102 ascends and the drag reducer 162 deploys as discussed above and as shown in FIG. 7B.

According to some embodiments, the payload delivery unit 10 may be dispensed dropped, ejected or released from a secondary object 7 such as a surface-going ship, submarine or submersible vehicle or a towed array connected to such a vessel or vehicle. With reference to FIG. 8, in an illustrative embodiment the payload delivery unit 10 is ejected from a ship 7. The payload delivery unit 10 is heavier than the water W and sinks to a submerged depth D. The payload 150 may monitor for signals or environmental parameters while descending to or residing at the depth D. Upon reaching the depth D or thereafter, the buoyancy control system 130 releases the cap 140, thereby causing the buoy 102 to buoyantly rise to or toward the water surface WS as shown in dashed lines in FIG. 8.

The payload delivery unit 10 may be initially deployed in any suitable location and manner. For example, the payload delivery unit 10 may be mounted on a vehicle (e.g., an unmanned underwater vehicle (UUV)), a platform, or the substratum G, or may float neutrally buoyantly between the substratum G and the surface WS of the water. Once deployed, the payload delivery unit 10 may hold the cap 140 and subsequently release the cap 140 from the buoy 102 responsive to the occurrence of a prescribed event, time or environmental condition.

In order to support initiation, coordination and/or execution of the step of releasing the cap 140 from the container 110, the payload controller 154A, and/or the buoyancy control module controller 132A may conduct appropriate processing and sense associated parameters. According to some embodiments, one or more of these controllers determine a depth of the payload delivery unit 10 (e.g., using a depth sensor), determine a location of the payload delivery unit 10 (e.g., using acoustic or optical localization), determine a time (e.g., using a computer clock) and/or determine an operational condition of the container 110 or the payload 150 (e.g., using a battery voltage detector).

Deployment of the payload delivery unit 10 may further include activating operation of one or more components of the payload 150 and/or the buoyancy control module 132, such as the controller 132A, the transducer 132B, the controller 154A or transducer 154B. For example, when the cap release procedure is initiated, the buoyancy control module 132 may automatically activate the controller 154A or the transducer 154B.

The link 139 between the buoyancy control module 132 and the payload 150 can be used to transmit energy, commands and/or data between the buoyancy control module 132 and the payload.

The payload delivery unit 10 may also send an activation confirmation to an external object, such as a secondary sensor, container, dispenser, operator console, or other operational object. Such an activation confirmation may be sent by the buoyancy control module controller 132A and/or the payload controller 154A, for example. The activation confirmation may include a confirmation that the cap 140 has been released, that the cap release procedure has been initiated, and/or that a component or components of the payload 150 have been activated.

The payload delivery unit 10 may also send an informational signal to an external object, such as a secondary sensor, container, dispenser, operator console, or other operational object. The informational signal may indicate the condition of the container system 100 and/or the condition or status of the payload 150.

The payload delivery unit 10 may also send or receive operational signals to/from an external object, such as a secondary container, dispenser, operator console, or other operational object. Operational signals may embody, for example, relayed messages, environmental conditions, events, etc. For example, an external object can transmit to the payload 150 signals that are desirably broadcast or operational instructions that determine operation of the payload 150, such as duration and strength of transducer emission and destruction of the housing 152, controller 154A or other payload component.

In some cases, the shell members 114, 116 are scuttled, such as by sinking following release of the payload 150. In some cases, a link is maintained between the payload 150 and a shell member 114, 116 or other shell component, which linked portion of the shell 112 is negatively buoyant and acts as a sea anchor to reduce motion of the payload 150 floating on the water surface WS.

As discussed above, the payload 150 may be the communications device adapted to float on the surface of the water or in the air. According to some embodiments, the payload 150 is deployed from an underwater location and passively floats to the water surface or above. From the floating location, the payload 150 sends and/or receives wireless communications signals to/from a remote device. The payload 150 may communicate with the remote device using electromagnetic, electrical, magnetic, optical, and/or acoustic signals. The payload 150 may also communicate (e.g., acoustically, optically, or magnetic inductively) with a remote device from an underwater location.

According to some embodiments, the payload 150 communicates with a remote device that is at least one of proximate the sea surface, in the air or on land using RF, optical, or acoustic signals. For example, according to some embodiments, the remote device is an apparatus or station other than the apparatus or station that deployed the payload 150, such as the remote apparatus 5 (FIG. 6C; e.g., a satellite) or the remote vehicle 7 (FIG. 8).

The communications between the payload 150 and the remote device may be one-way or two-way. For example, according to some embodiments, the payload 150 receives signals from an underwater device and forwards these signals to a device outside of the water such as the remote apparatus 15. Alternatively or additionally, the payload 150 receives signals from a device outside of the water such as the remote apparatus 5 and forwards these signals to an underwater device. In some such embodiments, the communications between the payload 150 and the remote underwater device are accomplished via acoustic signals and the communications between the payload 150 and the remote device outside the water are accomplished via RF signals.

According to some embodiments, the payload 150 rises towards or to the surface of the water to obtain information or data that may include: environmental parameters, geo-location coordinates, command and control signals, and/or mission updates, and communicates such data to an underwater device such as a monitoring station or vehicle. In some embodiments, the payload 150 wirelessly communicates such information to the submerged device.

In some embodiments, the payload 150 sends signals to the remote device including at least one of: a signal detected from another source; a signal from another source that has been processed by the payload 150; information related to the operation or status of the payload 150 itself; an environmental parameter sensed by the payload 150; a forwarded message from another source; an identifier of the payload 150; the current time; the current date; and the location of the payload 150. The payload 150 may transmit a message containing at least one of: an identifier of the payload 150; the time a signal or parameter was detected by the payload 150; a location; a raw signal; a signature; a classification; identification; and an estimate of a range or direction to a source of a signal.

According to some embodiments, the payload 150 senses an environmental parameter and/or communicates with a remote device while the payload 150 is floating submerged in the water, proximate the water surface, or above the water surface.

In some cases, the payload 150 is released to float to the surface and emit at least one of: an acoustic, optical, or electromagnetic signal. In some embodiments, the payload 150 is interrogated or commanded by another device to emit a communications signal.

In some cases, the payload 150 operates in response to a prescribed lapse of time or arrival of a prescribed time. For example, the payload 150 may begin emitting communications signals or "wake up" to receive communications signals at a pre-programmed time. In some cases, the payload 150 operates in response to a detected signal (e.g., an interrogation or command signal).

In some cases, the payload 150 operates in response to a detected event such as a received signal or an environmental event. In an illustrative use, the payload 150 acoustically detects a passing vessel, for example, by detecting an engine noise from the vessel. According to some embodiments, the payload 150 sends notification of the detected vessel to a remote receiver. In some cases, the notification includes additional data such as an identifier of the payload 150, a signal classification, the location where the detection occurred, and/or the time of the detection. Other environmental events that may trigger the payload 150 to communicate may include, for example, seismic activity, a tsunami, a storm, or any other event detectable by the payload 150.

According to some embodiments, the payload 150 while submerged senses an environmental parameter (e.g., water temperature and/or salinity) and thereafter the payload delivery unit 10 is released and dehisced to permit the payload 150 to float to the water surface or into the air to communicate the sensed data to a remote device.

An illustrative method of using the payload 150 includes measuring water parameters to characterize a sound velocity profile. Further methods of use may include characterizing or profiling water movement, induced vorticity, electrical conductivity of the water, water temperature, depth in the water, light intensity at one or more frequencies, turbidity, chlorophyll concentration in the water, dissolved oxygen concentration in the water, pH of the water, or identification of a type or concentration of material in the water including at least one of: organic, inorganic, chemical, biological, radiological, and toxic material.

According to some embodiments, the payload 150 is used to aid navigation, such as by providing a signal for direction finding. In some cases, the signal comprises additional information such as location, classification or identification information. In an illustrative example, the payload 150 is activated to emit sonar.

In some embodiments, the payload 150 is used to receive data and thereafter communicate the received data or modify its operation based on the received data.

According to some embodiments, the payload 150 is a single-use device. According to some embodiments, the payload 150 includes a scuttling system that destroys or sinks the payload 150, at least in part. For example, the payload 150 may include a hot wire, an explosive device, and/or a mechanical device that breaches the housing 152 to permit inflow of water or outflow of a gas or gases to cause the payload 150 to sink in the water or air. The payload 150 may include such a device or an electronic device to destroy a circuit of the payload 150.

While the container 110 has been described herein with reference to submersion in water, it will be appreciated that the container 110 may be submerged in other types of liquid and gas. The container 110 may also be submerged in sediments or other unconsolidated material.

Figure 9:
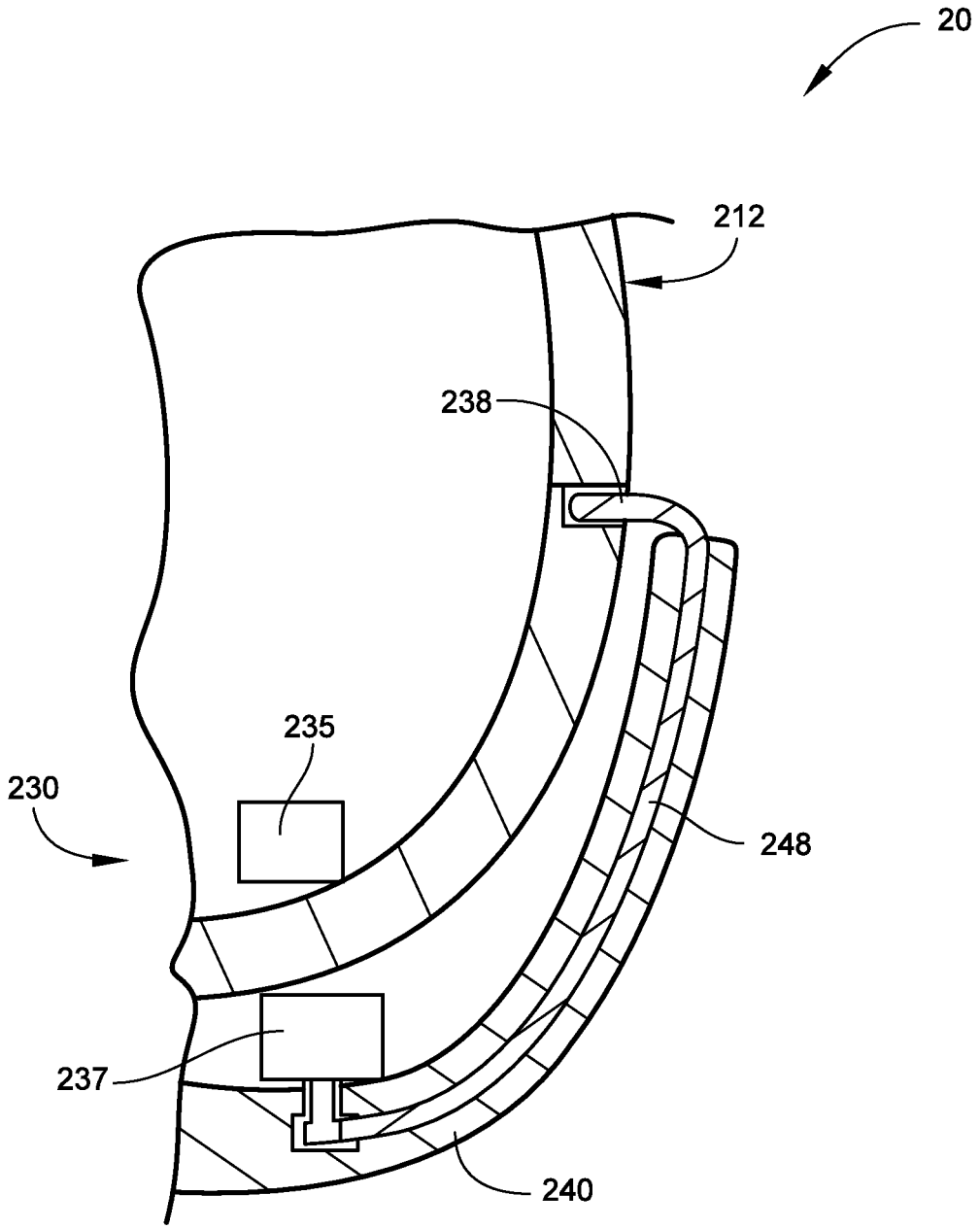
FIG. 9 is a fragmentary, enlarged, cross-sectional view of a payload delivery unit according to further embodiments of the present invention.

With reference to FIG. 9, a payload delivery unit 20 according to further embodiments of the present invention is shown therein. The payload delivery unit 20 corresponds to the payload delivery unit 10 except as follows. The payload delivery unit 20 includes a buoyancy control system 230 corresponding to the buoyancy control system 130 except that the electromagnet 134 and the component 136 are replaced with a send module 235 and a receive module 237. The cap 240 is retained on the shell 212 by one or more fingers 238 or other coupling structures. The modules 235, 237 and the fingers 238 form, at least in part, a mechanical retention system or mechanism operative to retain and selectively release the cap 240 with respect to the shell 212. When actuated, the receiver unit 237 withdraws the fingers 238 from the shell 212 via a linkage 248, thereby releasing the cap 240. For the purposes of explanation, the drag reducer corresponding to the drag reducer 162 is not shown in FIG. 9.

The send and receive modules 235, 237 may incorporate an inductive type actuator. One illustrative inductive type actuator is an induced force actuator, such as a flooded steering actuator as disclosed in U.S. Provisional Patent Application No. 61/019,668, and U.S. patent application Ser. No. 12/348,956, the disclosures of which are incorporated herein. The induced force actuator includes a sensing coil 235 inside the shell and a receiving unit 237 mounted on the cap 240. The receiving unit 237 comprises a receiving coil and a bearing mounted magnet, which receiving coil can induce rotation of the bearing mounted magnet. The bearing mounted magnet is further coupled by a tensile or compressive element and/or linkage 248 to the fingers 238 in any manner that can provide movement in response to force induced movement of the bearing mounted magnet.

A second illustrative inductive type actuator is an induced current actuator comprising a second coil 235 inside the shell 212 and a receiving coil 237 coupled to the cap 240. The receiving coil 237 is coupled to the cap 240 in any manner that can permit rotation or translation of the receiving coil 237. The receiving coil 237 is coupled to one or more tensile or compression transmitting elements and/or linkage 248 to one or more fingers 238 in any manner that can provide finger movement in response to rotation or translation of the receiving coil 237.

In some cases, the receiving coil 237 is any suitable type capable of operating in water deeper than 200 meters. Illustrative components having such coils include brushless DC motors, such as those sold by Maxon Precision Motors, Inc. of Fall River, Mass., as well as linear inductive devices such as Lorenz force actuators. In some cases, the actuator can be connected to the controller by a wet mate-able connector or a wire permanently embedded in the shell.

Figure 10:
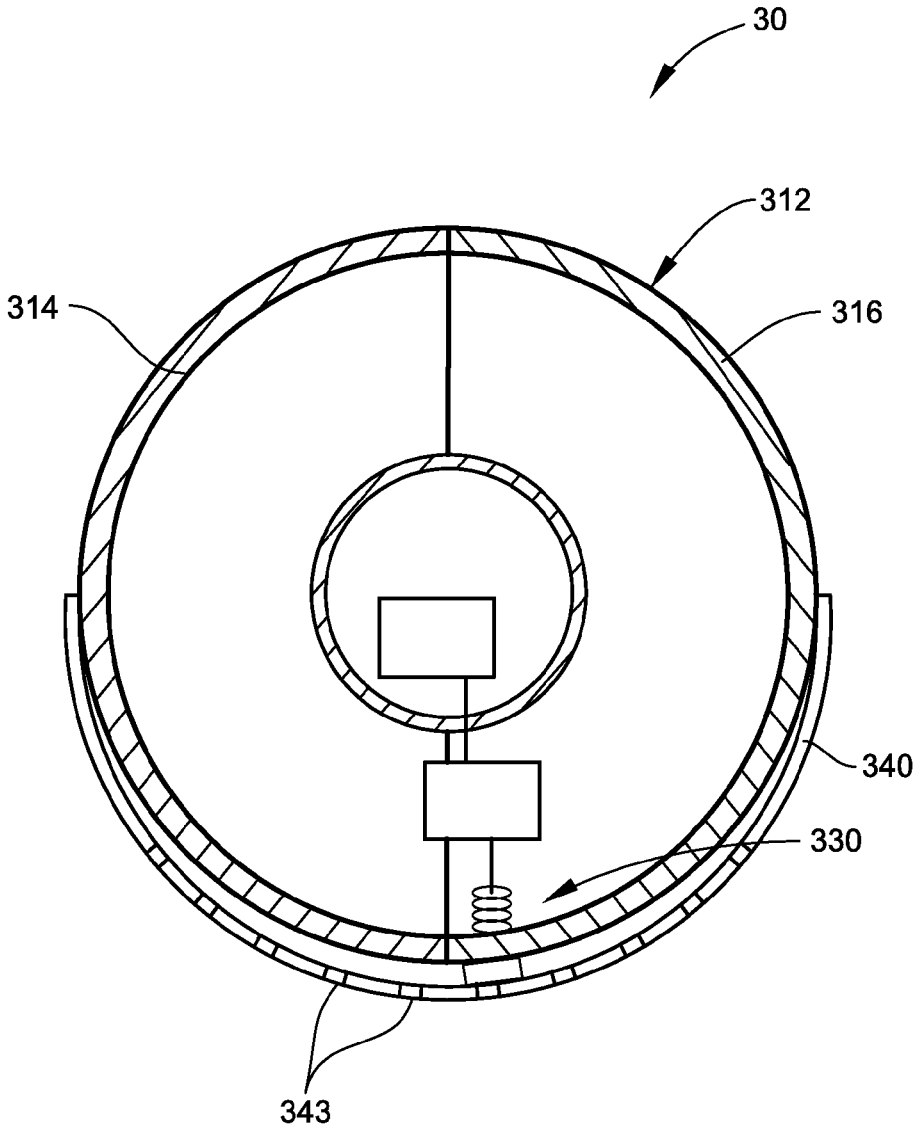
FIG. 10 is a cross-sectional view of a payload delivery unit according to further embodiments of the present invention.

With reference to FIG. 10, a payload delivery unit 30 according to further embodiments of the present invention is shown therein. The payload delivery unit 30 may correspond to the payload delivery unit 10 (or 20) except that the cap 340 overlaps each of the shell members 314, 316 to hold the shell members 314, 316 closed. Upon release of the cap 340 from the shell 312 by a cap control system 330, the cap 340 will no longer hold the shell members 314, 316 together, thereby permitting the shell members 314, 316 to separate. The separation of the shell members 314, 316 may occur immediately thereafter or upon occurrence of another event or condition (e.g., when an onboard dehiscing system is activated or the external pressure on the shell 312 is sufficiently relieved by ascent of the shell 312 through the water).

The cap 340 of the payload delivery unit 30 may also be fenestrated with perforations 343 to allow passage of water therethrough to assist in separating the cap 340 from the shell 312. This feature may similarly be employed in the caps 140, 240, for example.

Payload delivery systems and units according to embodiments of the present invention can provide significant advantages in construction, operation and effectiveness. The buoyancy control systems as disclosed herein can provide buoyancy changing mechanisms that are relatively inexpensive, do not slow buoyant rise, and require less onboard space (which may be needed for payload). The drag reducer systems as disclosed herein can likewise provide streamlining and, in some embodiments, are relatively inexpensive, do not slow buoyant rise, and require reduced onboard space. In particular, the drag reducer systems enable the use of a pressure-resistant spherical shape for the shell while mitigating the high fluid dynamic drag typically experienced with spherical containers. Payload delivery units of the present invention can enable enhanced deployment flexibility and reliability and provide reduced buoy rise times. Where the payload includes sensors to assess conditions at depth, these aspects can improve the value of the data exported from the submerged sensors.

While the drag reducer system 160 has been discussed hereinabove with regard to a positively buoyant buoy 102, the drag reducer system 160 may also be implemented on a negatively buoyant buoy 102. In this case, the drag reducer 162 will reduce the fluid dynamic drag on the buoy as it descends through the water.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and selectively release the drop weight member from the buoy;

wherein the drop weight member includes a cap mounted on a portion of and in close proximity to the shell and having a shape generally conformal to an exterior surface of the portion of the shell.

2. The payload delivery unit of claim 1 wherein the shell is substantially spherical.

3. The payload delivery unit of claim 2 wherein the cap is cup-shaped and is mounted on and surrounds a lower portion of the shell.

4. The payload delivery unit of claim 1 wherein the retention system includes an electromagnet and a controller operative to control the electromagnet to retain the drop weight member on the buoy and selectively release the drop weight member from the buoy.

5. The payload delivery unit of claim 1 wherein the retention system includes a mechanical retainer system operative to retain the drop weight member on the buoy and release the drop weight member from the buoy.

6. The payload delivery unit of claim 1 wherein the drop weight member is fenestrated.

7. The payload delivery unit of claim 1 including a pressure generator operable to generate an increase in pressure in the containment chamber to cause the shell to dehisce.

8. The payload delivery unit of claim 1 wherein the retention system is operative to automatically release the drop weight member from the buoy responsive to a prescribed event and/or environmental condition.

9. The payload delivery unit of claim 1 further including a deployable drag reducer mounted on the container in a stowed configuration, wherein:

the drag reducer is retained in the stowed position by the drop weight member; and upon release of the drop weight member from the buoy, the drag reducer is extendable into a deployed configuration wherein the drag reducer extends from the container to streamline the buoy and thereby reduce dynamic fluid drag on the buoy.

10. A method for protecting and delivering a payload submerged in a submersion medium, the method comprising:

providing a payload delivery unit including:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and to selectively release the drop weight member from the buoy;

submerging the buoy, the drop weight member and the retention system in the submersion medium with the drop weight member retained on the buoy by the retention system; and thereafter automatically releasing the drop weight member from the buoy using the retention system responsive to a prescribed event and/or environmental condition.

11. The method of claim 10 wherein:

the payload delivery unit further includes a deployable drag reducer mounted on the container in a stowed configuration and retained in the stowed position by the drop weight member; and the method further includes, after releasing the drop weight member from the buoy, extending the drag reducer into a deployed configuration wherein the drag reducer extends from the container to streamline the buoy and thereby reduce dynamic fluid drag on the buoy.

12. A payload delivery unit for protecting and delivering a payload submerged in a submersion medium, the payload delivery unit comprising an unmanned buoy including:

a container including a pressure-resistant container defining a sealed containment chamber; and a deployable drag reducer mounted on the container in a stowed configuration;

wherein the drag reducer is extendable into a deployed configuration wherein the drag reducer extends from the container to streamline the buoy and thereby reduce dynamic fluid drag on the buoy;

wherein the drag reducer includes a flexible, compliant, distensible flow control member; and the payload delivery unit is configured such that the flow control member is distended by a flow of the submersion medium as the buoy buoyantly ascends and/or descends in the submersion medium.

13. The payload delivery unit of claim 12 wherein the flow control member comprises a polymeric film.

14. The payload delivery unit of claim 12 including a valve to permit the flow of the submersion medium into the flow control member and to inhibit a flow of the submersion medium out of the flow control member.

15. The payload delivery unit of claim 12 including a mounting hoop securing the flow control member to the shell.

16. The payload delivery unit of claim 12 including a cap mounted on the container and retaining the drag reducer in the stowed configuration, wherein the cap is releasable from the container to permit the drag reducer to expand into the deployed position.

17. The payload delivery unit of claim 12 wherein the payload delivery system is operative to automatically deploy the drag reducer to the deployed position responsive to a prescribed event and/or environmental condition.

18. The payload delivery unit of claim 12 wherein the shell is substantially spherical.

19. A payload delivery unit for protecting and delivering a payload submerged in a submersion medium, the payload delivery unit comprising:

an unmanned buoy including a container, the container including a pressure-resistant shell defining a sealed containment chamber, wherein the shell includes first and second shell members coupled to form the shell and enclose the containment chamber;

a cap mounted on the shell; and a retention system operative to retain the cap on the buoy and selectively release the cap from the buoy;

wherein:

the cap is configured and positioned on the shell members to inhibit separation of the shell members from one another when the cap is retained on the buoy by the retention system; and the shell members are permitted to separate from one another after the cap is released from the buoy by the retention system.

20. The payload delivery unit of claim 19 wherein the cap is a drop weight having a negative buoyancy with respect to the submersion medium.

21. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and selectively release the drop weight member from the buoy;

wherein the retention system includes an electromagnet and a controller operative to control the electromagnet to retain the drop weight member on the buoy and selectively release the drop weight member from the buoy.

22. The payload delivery unit of claim 21 including a permanent magnet on the drop weight member, wherein:

the drop weight member is secured to the buoy by magnetic attraction between the permanent magnet and the electromagnet; and the retention system is operative to release the drop weight member from the buoy by energizing the electromagnet to at least partly offset the force exerted on the electromagnet by the permanent magnet.

23. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and selectively release the drop weight member from the buoy;

the retention system includes a mechanical retainer system operative to retain the drop weight member on the buoy and release the drop weight member from the buoy; and wherein the mechanical retainer system includes at least one finger on the drop weight member configured to engage and releasably secure the drop weight member to the shell.

24. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium;

a retention system operative to retain the drop weight member on the buoy and selectively release the drop weight member from the buoy; and a pressure generator operable to generate an increase in pressure in the containment chamber to cause the shell to dehisce.

25. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and selectively release the drop weight member from the buoy;

wherein the retention system is operative to automatically release the drop weight member from the buoy responsive to a prescribed event and/or environmental condition.

26. A payload delivery unit for protecting and delivering a payload submerged in a submersion medium, the payload delivery unit comprising:

an unmanned buoy including a container, the container including a pressure-resistant shell defining a sealed containment chamber;

a drop weight member mounted on the shell and having a negative buoyancy with respect to the submersion medium;

a retention system operative to retain the drop weight member on the buoy and selectively release the drop weight member from the buoy; and a deployable drag reducer mounted on the container in a stowed configuration;

wherein:

the drag reducer is retained in the stowed position by the drop weight member; and upon release of the drop weight member from the buoy, the drag reducer is extendable into a deployed configuration wherein the drag reducer extends from the container to streamline the buoy and thereby reduce dynamic fluid drag on the buoy.

27. A method for protecting and delivering a payload submerged in a submersion medium, the method comprising:

providing a payload delivery unit including:

an unmanned buoy including a container, the container including a pressure-resistant shell defining a sealed containment chamber;

a drop weight member mounted on the shell and having a negative buoyancy with respect to the submersion medium; and a retention system operative to retain the drop weight member on the buoy and to selectively release the drop weight member from the buoy;

submerging the buoy, the drop weight member and the retention system in the submersion medium with the drop weight member retained on the buoy by the retention system; and thereafter releasing the drop weight member from the buoy using the retention system;

wherein:

the payload delivery unit further includes a deployable drag reducer mounted on the container in a stowed configuration and retained in the stowed position by the drop weight member; and the method further includes, after releasing the drop weight member from the buoy, extending the drag reducer into a deployed configuration wherein the drag reducer extends from the container to streamline the buoy and thereby reduce dynamic fluid drag on the buoy.

28. A payload delivery unit for protecting and delivering a payload submerged in a submersion medium, the payload delivery unit comprising an unmanned buoy including:

a container including a pressure-resistant container defining a sealed containment chamber; and a deployable drag reducer mounted on the container in a stowed configuration;

wherein the drag reducer is extendable into a deployed configuration wherein the drag reducer extends from the container to streamline the buoy and thereby reduce dynamic fluid drag on the buoy; and wherein the shell is substantially spherical.

* * * * *